United States Patent [19]

Thompson et al.

[11] 3,967,549

[45] July 6, 1976

[54] INK SUPPLY SYSTEM FOR AN INK MIST PRINTER

[75] Inventors: Lester E. Thompson, Los Altos; Enrique J. Klein, Menlo Park; Myron E. Lee, Palo Alto, all of Calif.

[73] Assignee: Electroprint, Inc., Cupertino, Calif.

[22] Filed: May 11, 1973

[21] Appl. No.: 359,286

[52] U.S. Cl. ..... 101/1; 101/DIG. 13; 101/114; 101/335

[51] Int. Cl.[2] ..... G03G 13/06

[58] Field of Search ..... 101/1 R, 114, 129, 327, 101/335, 202, 426, DIG. 8, DIG. 13, 1; 355/10; 346/74 R, 74; 427/13, 18, 27, 30; 222/56, 76, 195, 196, 459, DIG. 1; 118/602, 603, 612; 117/17, 17.5, 37 LE, 93.41; 137/93, 386, 391; 55/10, 68, 89, 107, 338

[56] References Cited

UNITED STATES PATENTS

| | | | |
|---|---|---|---|
| 2,590,538 | 3/1952 | Huck | 118/602 X |
| 3,273,496 | 9/1966 | Melmon | 101/114 |
| 3,370,529 | 2/1968 | Michalchik | 101/426 X |
| 3,417,734 | 12/1968 | Simm et al. | 117/37 LE X |
| 3,443,878 | 5/1969 | Weber et al. | 101/129 X |
| 3,492,788 | 2/1970 | Hochgesand et al. | 55/68 X |
| 3,529,546 | 9/1970 | Kollar | 101/335 X |
| 3,649,358 | 3/1972 | Johnston | 118/612 X |
| 3,656,173 | 4/1972 | Fussel | 117/17.5 X |
| 3,667,500 | 6/1972 | Stone | 137/386 |
| 3,726,701 | 4/1973 | Nishikawa et al. | 117/17 |
| 3,729,898 | 5/1973 | Richardson | 55/10 X |
| 3,730,089 | 5/1973 | McCutcheon | 137/386 X |
| 3,739,800 | 6/1973 | Aasen et al. | 137/93 |
| 3,761,953 | 9/1973 | Helgeson et al. | 137/93 X |
| 3,762,133 | 10/1973 | Merriman et al. | 55/68 X |
| 3,779,166 | 12/1973 | Pressman et al. | 101/114 X |
| 3,789,794 | 2/1974 | Smith et al. | 118/602 |
| 3,802,164 | 4/1974 | Bowen | 55/338 |
| 3,809,556 | 5/1974 | Pressman et al. | 101/114 X |

*Primary Examiner*—J. Reed Fisher

*Attorney, Agent, or Firm*—Townsend and Townsend

[57] ABSTRACT

Methods and apparatus for supplying an ink mist to an electrostatic printing head or the like including means for continual replenishment, density monitoring, and density adjustment of the ink supply, and means for generating a highly uniform mist of ink droplets. An ion stream is modulated in accordance with images or characters to be printed. Ink mist is introduced into the ion stream. Ink particles impinged upon by ions become charged and are accelerated toward a receiving medium by an overall accelerating field. Ink not utilized by the printing mechanism is returned to the ink supply for recycling. The composition of the ink supply is regulated by means of continuous monitoring of the ink density; automatically controlling additions of the ink constituents functions to maintain the ink density at a given level. The ink recycling system includes a precipitator to convert the unused ink mist into liquid ink and air. Ink solvent vapors are removed from that air by a two-stage condenser and are returned to the ink supply. Ink mist is generated by a plurality of ultrasonic transducers located beneath the surface of a supply of liquid ink. To enhance uniformity, the mist is forced from a first chamber through a narrow aperture into a second chamber before leaving the generator. Mesh screens filter oversized droplets from the mist.

10 Claims, 12 Drawing Figures

INK SUPPLY SYSTEM FOR AN INK MIST PRINTER

The present invention relates to a new and improved system for electrostatic reproduction and in particular to an improvement in modulated aperture non-contact electrostatic printing wherein a modulated ion stream is directed into an uncharged mist of toner marking particles with specific attention directed to a system that continuously delivers, recovers and recirculates ink while monitoring and adjusting the density of the ink, and that generates a highly uniform mist of ink droplets. The invention is useful in a wide range of applications including document copiers and computer printout devices.

Reliability and printing performance of electrostatic printers using liquid ink are degraded if the density of the ink is allowed to vary. Variations in ink density are commonly caused by sedimentation of the ink dye or by a reduction in the amount of solvent present in the ink due to evaporation. The present system constantly monitors and adjusts the density of the ink supply by the use of automatically controlled valves that regulate the additions of ink constituents to the ink supply. Ink mist not utilized by the printing mechanism is reduced to a liquid form, and is returned to the ink supply.

One type of electrostatic printing apparatus for which the present system is intended employs a modulator element designed to support a double layer charge at apertures in the modulator for modulating an ion stream in accordance with an image to be reproduced, as set forth in commonly asigned U.S. patent application Ser. No. 101,681 filed Dec. 28, 1970, now U.S. Pat. No. 3,779,166 and entitled "ELECTROSTATIC PRINTING SYSTEM AND METHOD USING IONS AND TONER PARTICLES" now U.S. Pat. No. 3,779,166. The present invention may be employed to introduce a substantially uniform ink mist into the path of the modulated ion stream so that the ions impinge upon the mist particles causing them to become charged and accelerated by an electrical field toward a print receiving medium. Specially constructed modulator elements for use in systems of this sort are shown in commonly assigned U.S. Pat. No. 3,689,935 entitled "ELECTROSTATIC LINE PRINTER".

It has been known to generate mist by the method of introducing ultrasonic energy into a liquid. See, for example, U.S. Pat. No. 3,387,607 entitled "Apparatus for Inhalation Therapy". As an improvement on the prior art, the present device is capable of continuously producing and supplying a printing head or the like with a mist of ink droplets, substantially uniform in composition, both in time and in space, across a linear dimension on the order of one foot or more as is usually desired in line-by-line printing operations described in above mentioned application Ser. No. 101,681. This uniformity assures reliable printing across the full width of the printing mechanism. Continuous operation allows the mist generator to be used in the recycling system of the present invention.

Continuous operation is possible due to the fact that liquid may be added to the mist generator without releasing mist in the process, by the use of an inlet placed below the surface of the liquid already in the mist generator.

Uniformity of the mist through time is achieved by supplying the generator with ink of a constant density. Uniformity of the mist across the longitudinal dimension of the generator is gained by two features of the present invention. First, when more than one row of ultrasonic transducers are used, as is preferred, the rows are staggered so that mist is formed at all points along the longitudinal dimension of the generator. Further, prior to leaving the generator, all mist is forced to travel from the transducer chamber into a second chamber through a restricted aperture extending along that longitudinal dimension. Mist tending to be generated into the carrier gas in "puffs" at the transducers thus experiences mixing turbulence as it enters the second chamber and thereby becomes mixed with the carrier gas and relatively uniformly distributed therein before leaving the generator.

One object of the present invention is, therefore, to improve the performance and reliability of electrostatic printers utilizing a mist of ink droplets.

Another object of the invention is to assure uniform printing by creating an ink mist of uniform composition.

An advantage of the present invention is that the density of the ink is continuously monitored and adjusted while it is being recycled through the system.

Another advantage of the present invention is that it will function reliably without frequent maintenance.

These and other objects, features and advantages of the present invention will be more readily apparent after reading the following detailed description with reference to the accompanying drawings wherein.

I. Modulated Aperture Electrostatic Printing

A. General Background

The present art of modulated aperture electrostatic printing has developed from the early work in electrostatic screen printing by McFarlane, set forth in commonly assigned U.S. Pat. Nos. 3,220,831, 3,220,833, and 3,339,469. In this early work, a screen or other modulator was first prepared with an electrostatic charge corresponding to the image to be reproduced. This imaged modulator was dusted with charged toner particles and then the dusted screen exposed to an overall projection field which attracted the toner particles from the modulator across an air gap to paper or other print receiving medium to which it was fixed with heat or otherwise. The toner pattern was transferred across the air gap without substantial disruption.

Later work, disclosed in commonly assigned U.S. Pat. Nos. 3,625,604 and 3,645,614, enabled the toner particles to be projected directly from the toner source through the modulator (usually a screen) onto the print receiving medium or to a transfer surface, thus eliminating the step of dusting the modulator. The modulator could also be used to modulate an ion stream, as disclosed in commonly assigned U.S. Pat. No. 3,582,206, for subsequent development in a variety of ways. Importantly, the use of ions kept toner away from the screen and avoided the need for costly and time consuming screen cleaning steps. In addition, the low mass ions required relatively low gating voltages and smaller apertures, by comparison to the larger, heavier toner particles.

As disclosed in commonly assigned U.S. Pat. No. 3,689,935, modulators can be designed to accept a stream of electrical signals, such as from a computer, to rapidly vary the charge pattern on the modulator. High speed printing operations, such as are desired in computer printout applications, can be carried out with electrically addressed modulators.

B. Electrically Addressed Particle Modulators

Figure 1A:
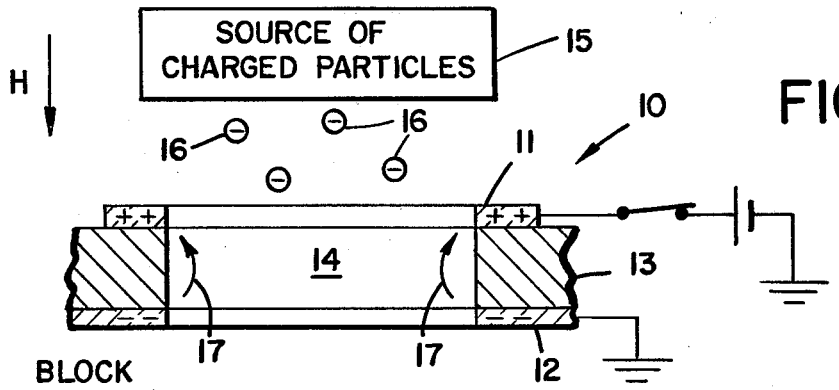
FIG. 1A is a side sectional segment of a modulating aperture for a modulated aperture electrostatic printing system, wherein such aperture is in a "block" condition.
Figure 1B:
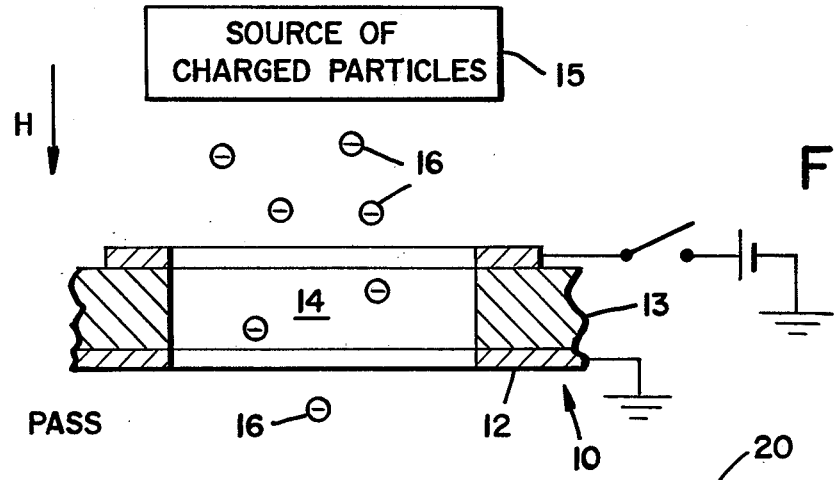
FIG. 1B shows the device of FIG. 1A but in a "pass" condition.

FIGS. 1A and 1B illustrate the effect of double layers of charge upon the passage of charged particles through an electrically addressed particle modulator 10. The modulator 10 has an aperture 14 with first and second conductive layers 11 and 12 carried on a thin electrical insulator layer 13. The ratio of insulator 13 thickness to aperture 14 diameter (T/D ratio) is less than 1.00 and preferably about 0.25. The conductive layer 11 facing the source 15 of charged particles 16 is biased with opposite polarity from the charged particles 16 and the opposed conductive layer 12 is grounded, so that a double layer of charge is formed at the aperture 14 creating electrostatic lines of force or fringing fields 17 within the apertures 14 which tend to block the passage charged particles 16 therethrough, as shown. FIG. 1B illustrates how charged particles 16, under the influence of overall projection field H pass through the modulator 10 when the modulator bias is removed. If the charged particles are toner or ink, they can be deposited directly on the print receiving medium; however, it is preferred that the charged particles be gaseous ions. A modulated ion stream is developed in the manner shown in FIG. 2.

C. Printing With Ions and a Mist of Printing Particles

Figure 2:
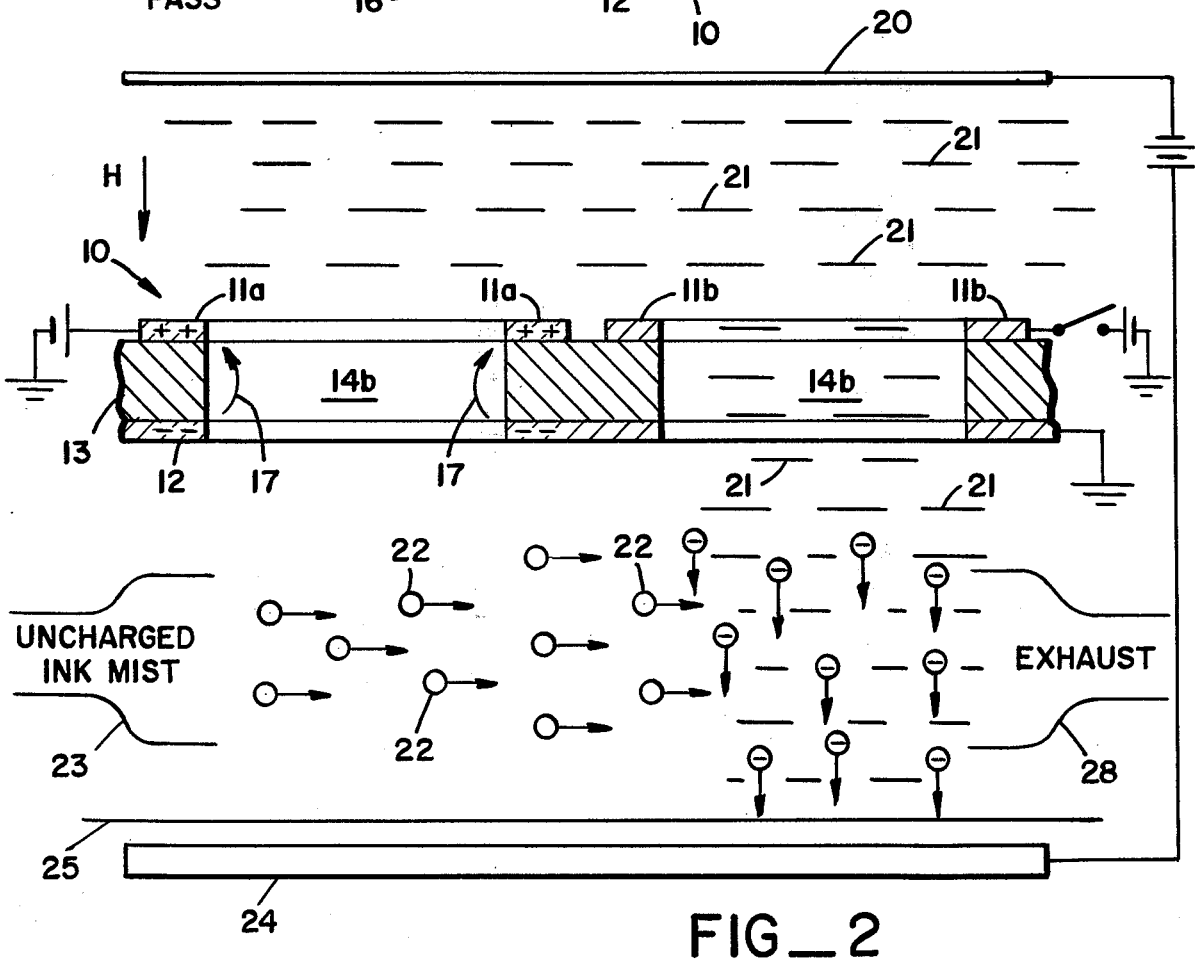
FIG. 2 is a schematic diagram illustrating modulated aperture electrostatic printing wherein a stream of negative ions is modulated and the modulated stream directed into an uncharged ink mist whereupon collected particles in the mist are charged and diverted toward a print receiving medium under the influence of an electrostatic field.

FIG. 2 illustrates a system for electrostatic printing wherein a stream of ions which has been modulated with an electrically addressed modulator 10 in the manner shown in FIGS. 1A and 1B is developed by directing the modulated ion stream into a substantially uncharged cloud or mist of printing particles which may be solid toner particles but are preferably liquid ink droplets. In FIGS. 1A, 1B and 2, corresponding elements are correspondingly numbered. Specifically, FIG. 2 shows ions 21 from an ion source, i.e. corona wire 20, being flooded on a particle modulator 10. The segmented upper conductor layer 11*a* is charged, establishing fringing fields 17 in the aperture 14*a* which block ions 21 from passing therethrough. By comparison, segment 11*b* of the upper conductor is not charged and ions 21 pass through the aperture 14*b* (under the influence of overall projection field H) established between the corona wire 20 and reverse polarity electrode 24 (also referred to as the "backbar" 24) and impinge upon uncharged particles of ink 22 supplied from uncharged ink mist generator 23. Uncharged ink particles 22 which are struck by the ions 21 become charged and are accelerated by the field H onto the paper 25 interposed therein. Particles 27*b* which are not struck by ions 26 continue laterally to an exhaust duct 28. When liquid ink particles are employed, as is preferred, the system has several important advantages including that it prints on ordinary, untreated paper and does so without a further developing step or the use of an intermediate transfer surface. The foregoing is set forth in greater detail and scope in commonly assigned U.S. patent application Ser. No. 101,681 of Pressman, et al. filed Dec. 28, 1970.

Figure 3:
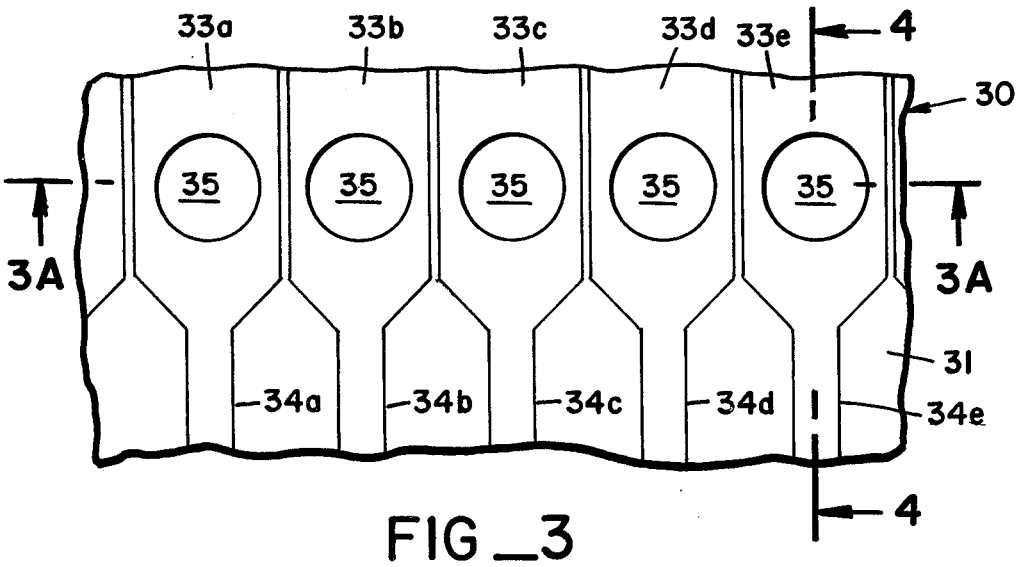
FIG. 3 is a plan view of a segment of a modulated aperture electrostatic line printer.
Figure 3A:
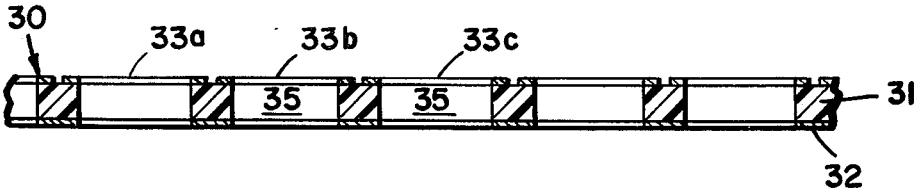
FIG. 3A is a side sectional view of the line printer illustrated in FIG. 3.

FIGS. 3 and 3A illustrate an electrically addressable particle modulator wherein the modulating element 30 consists of an elongate length or bar of insulating material 31 with a continuous layer of conducting material 32 on one side and a segmented conductive layer 33 on the other. Segmented conductive layer 33 consists of individual insulatively isolated segments 33*a*, 33*b*, 33*c*, etc. The element 30 is formed with a row of apertures therethrough, each aperture surrounded by a conductive segment 33*a*, 33*b*, 33*c*, etc. An electrical lead is provided to the continuous conductive layer 32 for applying a uniform potential across one face of the insulative layer 31. A plurality of electrical leads 34*a*, 34*b*, 34*c*, etc., are provided one for each of the conductive segments 33*a*, 33*b*, 33*c*, etc., so that a different potential can be applied to each of the segments for creating selectively different double layers of charge at each of the apertures 35 in accordance with a pattern to be reproduced. A particle modulator constructed in this manner, sometimes referred to as a "line printer", is employed in line-at-a-time printing operations, such as in facsimile printing or computer data printers. In the usual case, the print receiving medium is translated past the particle modulator and ink particles deposited on the medium in line patterns in accordance with selected electrical signals supplied to the segmented conductors 33*a*, 33*b*, 33*c*. A preferred construction of a line printer formed of flexible material and assemblies therefor are disclosed in commonly assigned U.S. Pat. No. 3,863,261 by Enrique Klein, entitled "Electrically Addressed Apertured Modulator For Electrostatic Printing".

Figure 4:
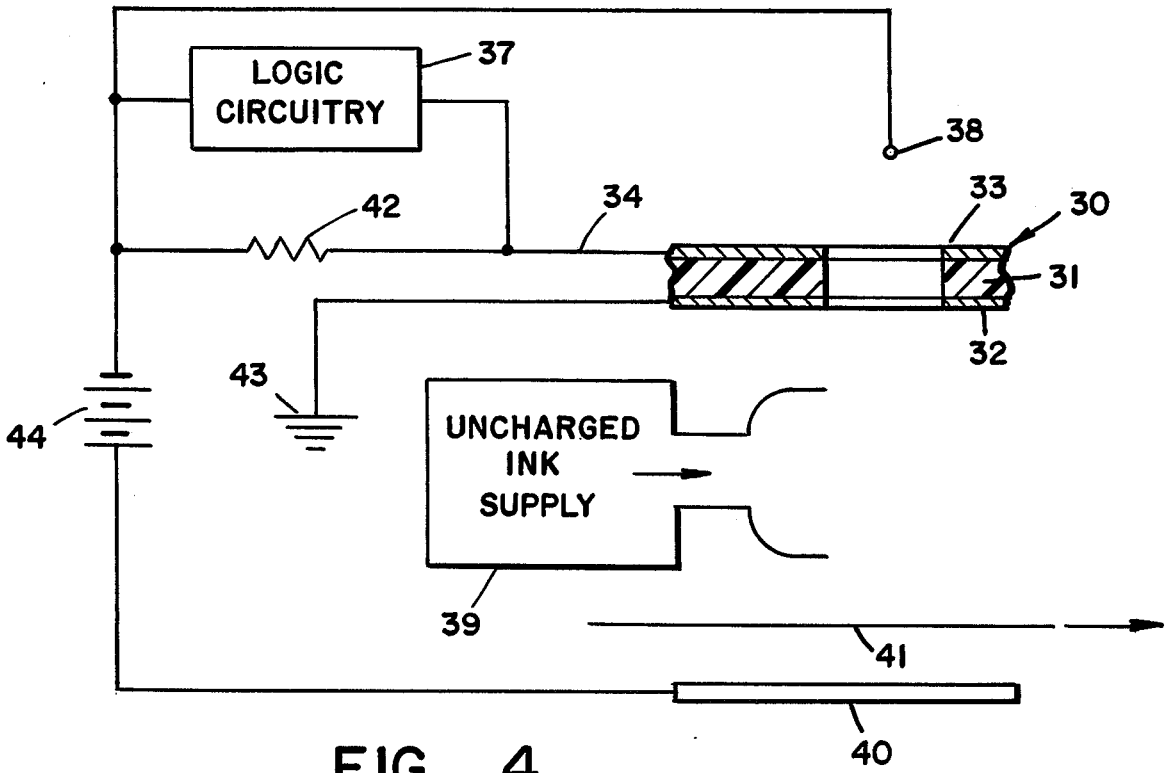
FIG. 4 is a schematic diagram of a modulated aperture electrostatic printer utilizing the process depicted in FIG. 2 with printing signals from a logic circuit, such as in a computer printer.

FIG. 4 is a diagram for a computer printer utilizing the particle modulator 30 illustrated in FIGS. 3 and 3A, with corresponding parts numbered accordingly. Each of the conductive segments 33 is connected by a separate electrical lead 34 through resistance 42 and appropriate logic circuitry 37 to an electrical power supply 44. Continuous conductive coating 32 is connected to a fixed potential or ground 43. As in the preferred system of FIG. 2, uncharged ink particles from supply 39 are introduced into a stream of ions emanating from corona wire 38 after they have been modulated by passage through the modulator aperture 35. Ions impinging upon toner particles become charged and are attracted towards the print receiving medium 41 by the backbar electrode 40. The print receiving medium is translated continuously transversely to the ion flow for printing.

Figure 6:
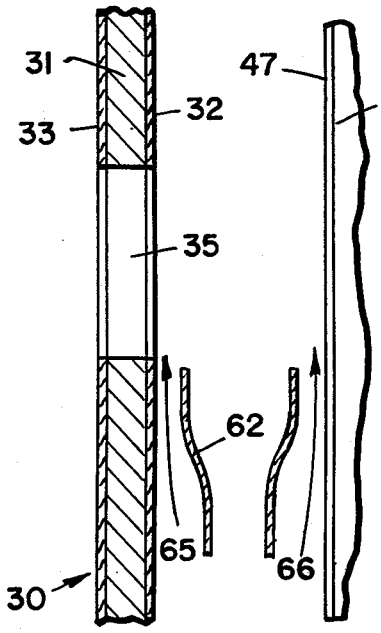
FIG. 6 is a side sectional segment of a modulator for use in a modulated aperture electrostatic printing system depicting the use of air boundaries to prevent ink from collecting accidentally on either the paper or the modulator.

Electrically addressed systems according to the present invention can also include systems of the type employing photodetector arrangements, for example, as shown in FIG. 6 of U.S. Pat. No. 3,689,935 wherein a linear array of photodetectors detect an optical image at a distance from a modulator of the type shown at 30 in FIG. 3 herein, transforming linear segments of such image into electrical signals carried to the modulator 30 by a plurality of separate electrical leads 34*a*, *b* and *c*.

Figure 5:
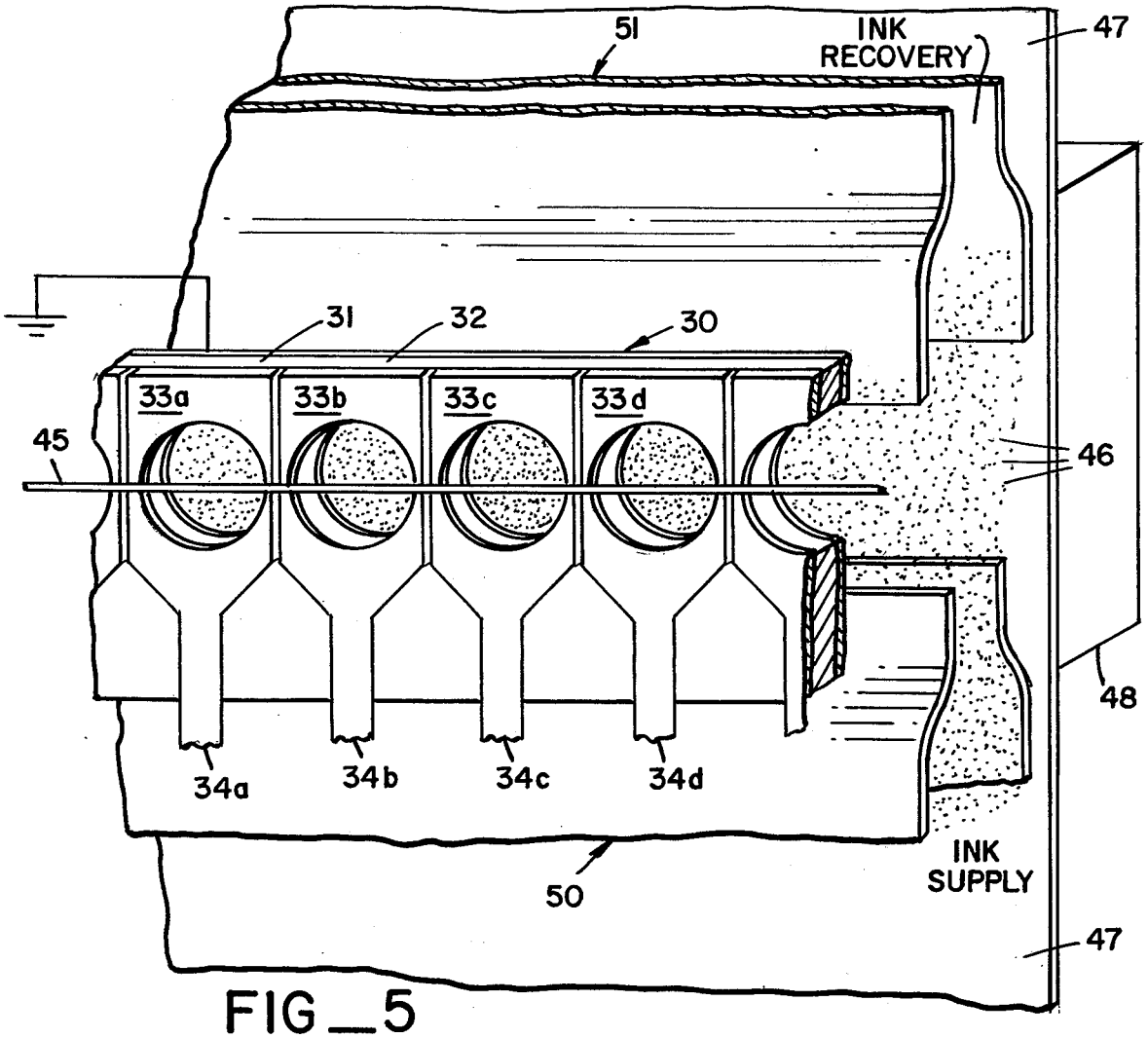
FIG. 5 is a perspective view of apparatus designed for practicing the process illustrated schematically in FIG. 2.

FIG. 5 illustrates apparatus for printing with the ion and ink mist process described in connection with FIGS. 1 through 4 utilizing the line printer type of particle modulator shown in FIGS. 3 and 3A with like elements correspondingly numbered. The apparatus includes, in addition to the particle modulator 30, a corona wire ion source 45 disposed on one side of the particle modulator 30 adjacent the conductive segments 33, and a target electrode 48 positioned on the opposite side of the particle modulator 30. A sheet of paper or other print receiving medium 47 is disposed between the particle modulator 30 and the target electrode 48 and is translated therebetween in a direction perpendicular to the row of modulator apertures 35. An ink supply conduit 50 and an ink recovery conduit 51 are positioned on laterally opposite sides of the row of apertures 35 between the particle modulator 30 and the paper 47. In operation, individual electrical signals are selectively supplied to the apertures 35 through electrical leads 34*a–d* to selectively modulate a flow of ions from the corona wire 45 through the various apertures 35. The individual apertures will either be in a block or pass condition as illustrated in FIGS. 1A and 1B respectively. An aperture which is in the block condition will not permit ions to pass through and no printing will occur opposite such aperture. An aperture in the pass condition will permit ions from the corona source 45 to pass through the apertures to impinge upon uncharged particles of ink mist 46 which are, in turn, charged themselves and attracted toward the back electrode 48 to deposit upon the interposed paper 47. Circuitry for this apparatus is essentially as shown in FIG. 4, so that the conductive continuous layer 32 is held at ground potential, while each of the conductive segments 34 is connected to individual switching elements from a data source, as logic circuitry in a computer. While only one row of apertures 35 is shown in FIG. 5, additional rows of apertures can be used, as set forth in U.S. patent application Ser. No. 684,022 and others referred to abcve. Particles depositing on the paper form dot patterns in accordance with linear segments of the data to be printed or pattern to be reproduced. Additional line patterns of dots are laid down parallel and in succession as the paper 47 is translated past the particle modulator, thereby generating a two-dimensional printout. The speed of the print receiving medium is synchronized with the flow of linear data patterns delivered to the particle modulator and the flow of ink mist from the ink supply conduit 50 to the ink recovery conduit 51 is matched to the speed of the paper 47 as closely as possible so that, under ideal conditions, the relative lateral speed of the ink mist 46 and the paper 47 is zero. The ink mist should be of substantially uniform density to avoid variations in print densities. Ink mist droplet sizes should be substantially uniform, although some variations in droplet sizes can be tolerated when the mist and paper velocites are matched since, under these conditions, it becomes relatively unimportant that certain particles have greater mass and accordingly take longer to reach the print receiving medium than other lighter particles in the same cloud. The ink mist should be substantially uncharged, prior to its introduction into the modulated ion stream, since charged particles can be attracted to the paper 47 in indiscriminate patterns unrelated to the data to be printed or to the operation of the particle modulator 30. It will be appreciated that liquid inks have substantial advantages over solid toner particles in the present process since solid particles are almost impossible to form into clouds without substantial, unintentional, triboelectric charging, whereas liquid inks are more easily misted into an uncharged cloud. While unintentionally charged solid particles attracted to the particle modulator 30 tend to build up undesirable deposits, liquid ink droplets which deposit on the particle modulator 30 tend to collect and run off harmlessly. Additional advantages of liquid inks in the present system include that they are absorbed directly into the paper in the desired pattern and are, therefore immediately maintained in a fixed such pattern. By comparison, solid toner particles must be held on the paper by electrostatic forces until they are transported to a station for permanent fixing by heat and/or pressure, all of which requires additional apparatus and provides added opportunities for unintentional disruption of the developed image prior to fixing. Plain paper can be utilized when liquid inks are employed whereas, when solid particles are used, the paper must be treated to render it electrically insulating or else an intermediate transfer surface must be employed. Lastly, it will be appreciated that the ink mist is most preferably confined to a straight flow and should be prevented from any flow in directions toward either the paper or the particle modulator. Unused portions of the ink mist are collected by the ink recovery conduit 51 and preferably transported to reprocessing stations for subsequent reuse.

Thus, it will be appreciated that the advantages of the printing apparatus disclosed in FIGS. 1 through 5 can be most fully realized if it is possible to generate a substantially uncharged mist of ink droplets of substantially uniform size and density, to control the flow of such mist within narrow time and space limitations, and to provide for recovery and reprocessing of the mist for reuse. The accomplishment of such goals are, therefore, principal objectives of the present invention, and methods and apparatus for accomplishing such goals are disclosed herein.

Figure 7:
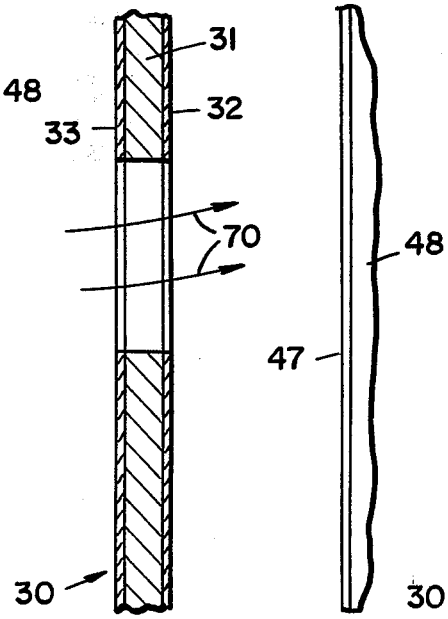
FIG. 7 illustrates the use of air flowing through the aperture of a modulated aperture electrostatic printing element to maintain the apertures free of printing particles.
Figure 8:
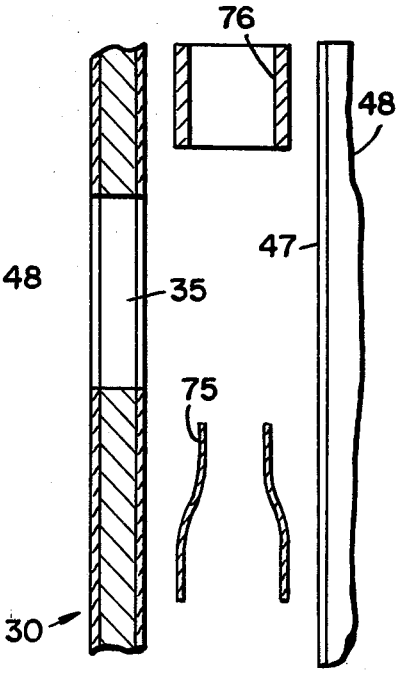
FIG. 8 illustrates apparatus for controlling the flow of uncharged printing particles in a direction transverse to the flow of the modulated ion stream (not shown).

It will be appreciated that the ink mist, even though substantially uncharged, may have a tendency to drift away from its straight path toward either the particle modulator 30 or paper 47. This tendency to drift can be controlled with protective air boundaries 65 and 66 injected along the surfaces of the particle modulator 30 and paper surface 47 respectively, as shown in FIG. 6. In the embodiment shown, the ink supply conduit 62 is shaped to allow for the injections of air boundaries 65 and 66. Alternatively, specially shaped additional conduits can be employed, as will be apparent. FIG. 7 illustrates how a flow of air 70 can be directed through the particle modulator 30 toward the print receiving medium 47 to prevent the ink from entering the particle modulator apertures 35. This may be accomplished by maintaining suitable pressure differentials on opposite sides of the particle modulator 30. Usually it will be preferable to maintain these pressure differentials small to avoid an excessive disruption of the ink mist cloud. FIG. 8 illustrates an ink supply conduit 75 and an oppositely positioned ink recovery conduit 76. By this expedient, when appropriate pressure differentials are maintained in the conduits 75 and 76, the velocity of the ink mist in the printing region can be accurately controlled, thereby enabling the ink mist velocity to be synchronized with the paper to prevent distortion of the printing pattern as described.

II. Generation, Delivery, Recovery and Reprocessing of An Ink Mist

Figure 9:
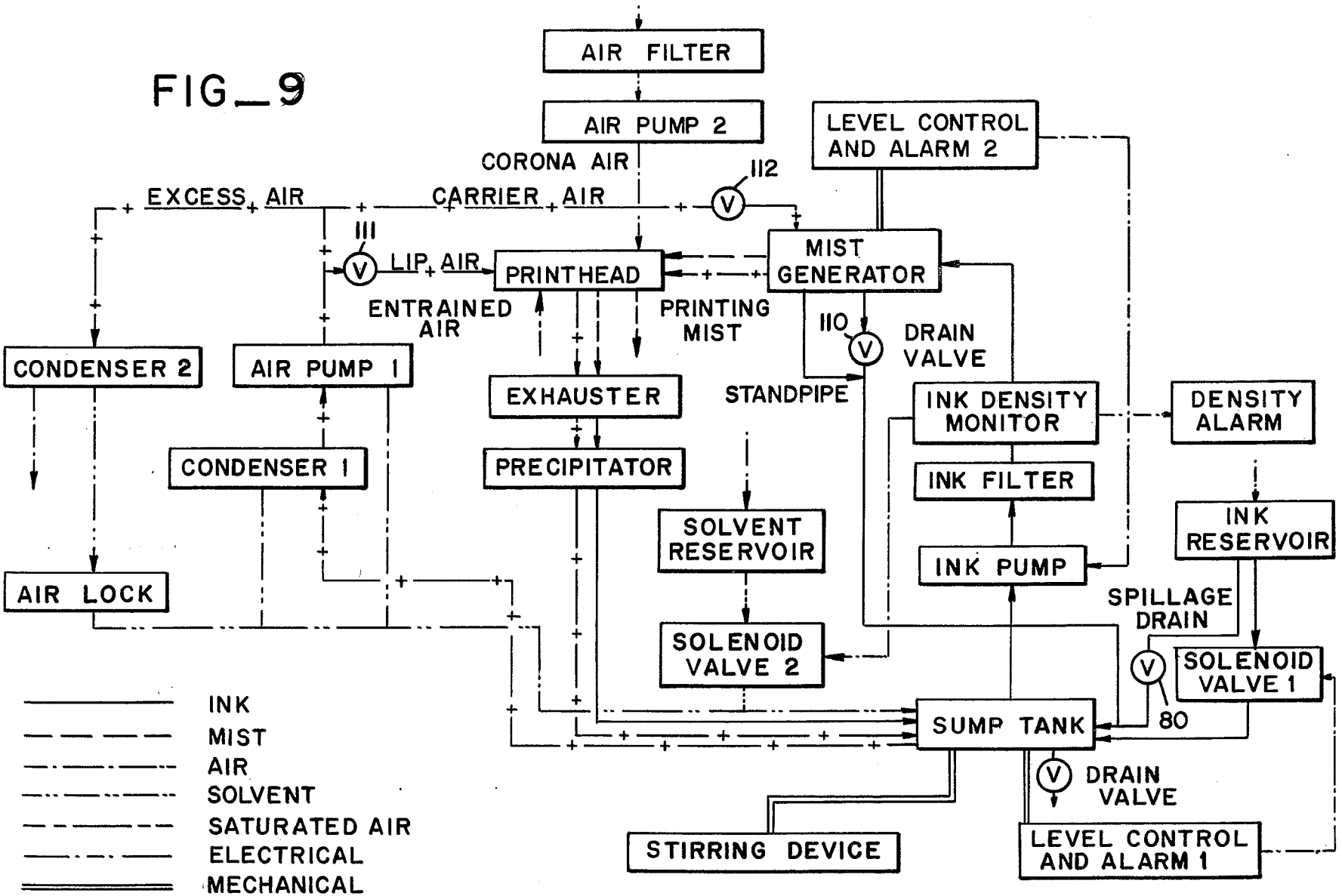
FIG. 9 is a flow chart of a system for generating delivering, recovering and reprocessing ink mist in printing systems of the type illustrated by FIGS. 2 and 5–8.

FIG. 9 provides a block diagram for the generation, delivery, recovery and reprocessing of ink mists in the system of the present invention, showing each functional element as a separate box. Interconnections between the boxes denote electrical and mechanical connections and conduits for the flow of various substances between the elements, the direction of flow being shown by arrows. The nature of each interconnection is indicated by the character of the line as coded in the accompanying legend.

Referring now in greater detail to FIG. 9, there is shown a sump tank for holding a quantity of liquid ink and provided with controls and other devices to uniformly maintain that ink at a particular composition. The major supply of ink to the sump tank is from the ink reservoir. Ink flows from the reservoir through a conduit into the sump tank when solenoid valve No. 1 is open. The ink reservoir is provided with a spillage drain so that if the ink reservoir is overfilled the excess ink will flow into the sump tank. The spillage drain may be closed by means of the valve 80. Solvent is supplied to the sump tank from the solvent reservoir when solenoid valve No. 2 is open. Both the solvent reservoir and ink reservoir may be filled manually. The sump tank is provided with a drain valve to empty it for cleaning or shut down. The contents of the sump tank are stirred continuously by means of the stirring device. The level of the contents of the sump tank is continuously monitored by level control and alarm No. 1, which has three functions. First, when the liquid level in the sump rises above a predetermined first level, level control and alarm No. 1 provides an electrical signal to close the solenoid valve No. 1, thereby shutting down the supply of ink to the sump from the ink reservoir. Second, when the liquid level in the sump falls below a predetermined second level lower than the predetermined first level, level control and alarm No. 1 provides an electrical signal to open the solenoid valve No. 1 and thereby replenish the supply of ink in the sump. And, third, when the liquid level in the sump falls below a third predetermined level lower than the second, level control and alarm No. 1 provides a signal to the operator indicating that the ink reservoir must be refilled with fresh ink. Ink from the sump tank is pumped by the ink pump through the ink filter and the ink density monitor into the mist generator. The ink filter removes foreign matter from the ink before it enters the mist generator to prevent clogging of the mist generating apparatus. The ink density monitor continuously monitors the density of ink flowing through it. When the ink density monitor senses an ink density greater than a predetermined first level, it provides an electrical signal to open the solenoid valve No. 2 to permit solvent to flow from the solvent reservoir into the sump. When the ink density monitor senses an ink density less than a predetermined second level lower than the first level, it provides an electrical signal to close solenoid valve No. 2 and stop addition of further solvent to the contents of the sump tank.

When the ink density monitor senses an ink density greater than a predetermined third level, higher than the first level, it provides an electrical signal to activate the density alarm which alerts the operator to the necessity of refilling the solvent reservoir.

Figure 10:
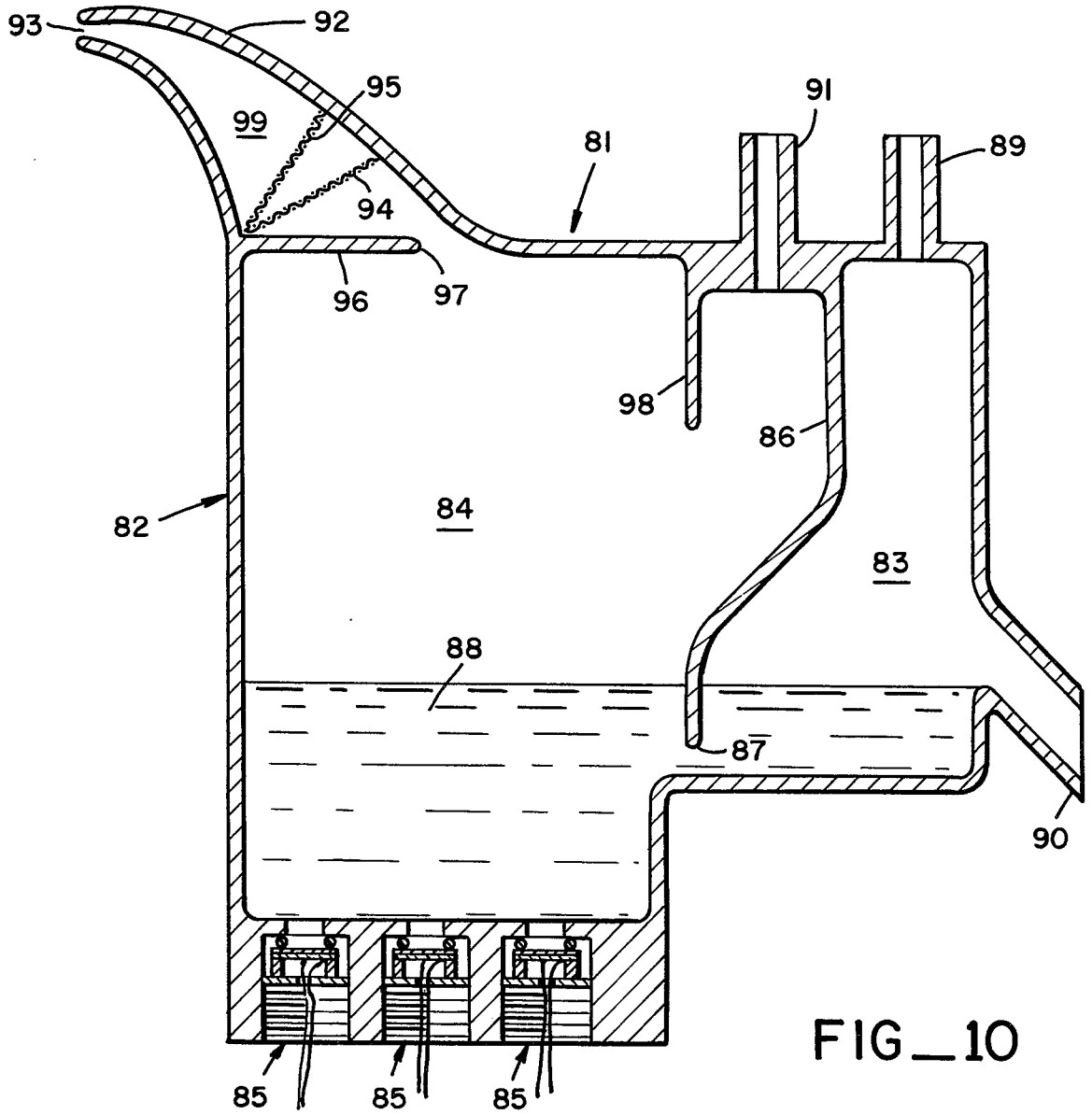
FIG. 10 is a side sectional view of a mist generator for use in the present system.
Figure 10A:
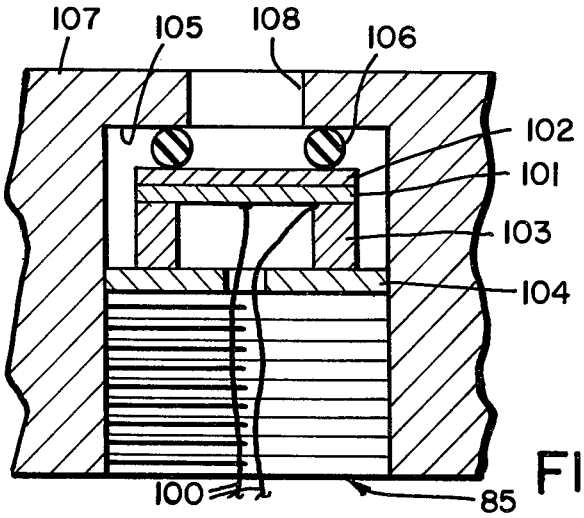
FIG. 10A is a side sectional detail view of an ultrasonic mist generating transducer and mounting arranging utilized in the mist generator of FIG. 10.

The mist generator creates a fine substantially uniform mist of ink droplets from the liquid ink supplied to it from the sump tank. FIGS. 10 and 10A illustrate the mist generator, shown generally at 81. The mist generator is formed of a housing 82 having an ink supply chamber 83 and a mist generating chamber 84. Ultrasonic transducers, indicated generally at 85, are mounted in the housing 82 at the base of the mist generating chamber 84. The ink supply and mist generating chambers 83 and 84, respectively, are separated by a wall 86 having a lower opening 87 which joins those chambers 83 and 84 beneath the liquid level of the ink 88. The ink 88 is supplied to the ink supply chamber 83 through inlet 89 located at the top of the ink supply chamber 83. Standpipe drain outlet 90 maintains the liquid level of the ink 88 at a predetermined level as illustrated in FIG. 10. An air inlet 91 is located at the top of the mist generating chamber 84 adjacent the chamber separating wall 86. A mist outlet conduit 92 having an elongated outlet slit 93 is located at the top of the mist generating chamber 84. The mist outlet conduit 92 corresponds to the ink supply conduit 50 illustrated in FIG. 5 and to the conduits 62 and 75 shown in FIGS. 6 and 8 respectively. As best illustrated in FIG. 5, the opening 93 is elongated to supply ink mist to the print head in a uniform stream having an elongated cross-section corresponding to the width of the paper and the length of the row of modulator apertures 35. A first screen 94 spans the outlet passage of the mist outlet conduit 92. A second screen 95, also spanning the passage 99, is positioned downstream in the mist stream from the first screen 94. A horizontally extending lip 96 projects from the front wall of the housing 82 to control the mist passing from the mist generation chamber 84 into the mist outlet conduit 92, and thereby defines an opening 97 communicating between the mist generation chamber 84 and the mist outlet conduit 92. A vertically extending lip 98 projects downwardly from the roof of mist generating chamber 84 adjacent the air inlet 91 and serves as a baffle for the incoming air to allow for a slight pressurization of chamber 84 which is used to expel the mist cloud from the elongated opening 93.

In operation, liquid ink 88 is introduced into the ink supply chamber 83 through inlet 89 and rises to the maximum liquid level shown. Higher levels are prevented by spillage from the standpipe outlet 90. The ink 88 flows from the supply chamber 83 into the mist generating chamber 84 through opening 87 located beneath the liquid level of the ink pool 88. When activated, each of the ultrasonic transducers 85 agitates the ink pool 88 to create a multitude of fine droplets above the surface of the liquid pool 88 within the mist generating chamber 84. Air, saturated with solvent vapors is introduced into the mist generating chamber 84 under slight pressure to mix with the ink droplets and form the air-mist mixture. This mixture flows out of the mist chamber 84 across the lip 96 through the opening 97 helps in and then out through the outlet slit 93. The lip 96, 99, causing the mist to distribute itself uniformly along the outlet at slit 93. The mist must pass through the screens 94 and 95 to maintain the mist droplets below some predetermined size. The mist exits the generator 81 at outlet 93 and is available along the entire outlet slit length for use at the printing head as illustrated in FIG. 5.

One of the ultrasonic transducers 85 is shown in detail at FIG. 10A. For printing on a web of conventional 15 inch wide fanfold computer paper, we prefer to use an array or rows of transducers. And with ten transducers in the two outer rows and 9 transducers in an offset middle row. This arrangement provides a more uniform mist distribution in the chamber 84 than other arrangements, though other arrangements may be employed as desired. Electrical energy of an appropriate frequency and power is conducted to each of the transducer crystals from a separate amplifier by means of paired electrical leads 100. The crystals are of a piezoelectric material. In one embodiment, the crystal is a disc 101 of lead zirconate titanate approximately 0.6 inch in diameter and 0.1 inch thick. The crystal 101 is bonded to the underside of a similarly shaped metallic disc 102. The crystal disc 101 is supported by an annular spacer 103. This entire assembly 101, 102, 103 is supported on a threaded washer 104, which is screwed into the threaded transducer cavity 105 and presses the assembly 101, 102, 103 upwardly against the underside of an O-ring 106. The upper surface of the O-ring 106 is thrust against the underside of the floor 107 of the mist generating chamber 84 at an aperture 108. The aperture 108 is formed in the floor 107 of the mist generating chamber 84 to facilitate transmission of the ultrasonic vibrations to the ink 88. Preferably, the crystals are driven at between about 1.2 – 1.4 megahertz, at between about 45–55 watts power. This produces sonic fountains at the liquid surface approximately 3 inches high. Droplets dispersed from these fountains are about 2–15 microns in diameter. The screens 94 and 95 are of a mesh size necessary to filter out very large drops, usually on the order of about 1/16 inch in diameter.

Referring once again to FIG. 9, the standpipe drain outlet 90 drains directly into the sump tank. Level Control and Alarm No. 2 monitors the level of liquid within the mist generator and provides an electrical signal to turn off the ink pump if the liquid level within the mist generator should rise above a predetermined level higher than the standpipe drain 90 and simultaneously provides a signal that warns the operator that the standpipe drain 90 may be clogged. Level Control and Alarm No. 2 provides a second electrical signal to alert the operator when the liquid level in the mist generator falls below a predetermined level lower than the level of the standpipe drain. The ink pump is operated continuously to insure adequate mixing of the ink and to provide cooling of the ink by circulating it through an ink cooler.

The print head or printing region as illustrated in FIG. 5, together with the features and devices illustrated in FIGS. 6–8, must be supplied with various substances to carry out their respective functions. Delivery of the ink mist has been described previously. As shown in FIG. 9, additional substances supplied to the print head includes fresh air drawn through the air filter and supplied to the modulator apertures 35 by air pump No. 2 to maintain those apertures free of ink by the technique illustrated in FIG. 7. Saturated air is drawn from the sump tank by air pump No. 1 through Condenser No. 1. A portion of this saturated air is supplied to the mist generator air inlet 91, as described previously, while other portions are delivered to the print head on either side of the ink supply conduit to form air boundaries 65 and 66 as illustrated in FIG. 6. Air boundaries 65 and 66 are also referred to herein and in the drawings as "Lip Air". A valve 111 controls the flow of lip air to the print head. Another substance supplied to the print head is "Entrained Air" drawn from the ambient atmosphere due to the fact that the print head is not sealed off from the ambient atmosphere. Air supplied to the air inlet 91 of the mist generator 81 is referred to elsewhere herein and in the drawings as "Carrier Air".

Unused portions of the ink mist and saturated air are drawn from the print head region by the exhauster as indicated in the diagram of FIG. 9. The exhauster may be any suitable conventional pumping mechanism. The exhauster draws these substances into an inlet, such as the ink recovery conduit 51 shown in FIG. 5 and forces these substances through a precipitator. The precipitator separates liquid ink from the exhaust fluid. The precipitated ink is returned through a conduit to the sump tank for reuse. In this regard it will be noted that ink returned to the sump tank from the precipitator will generally have a slightly different composition than the ink supplied to the mist generator, usually due to evaporation of the solvent constituent during the mist stage, but also sometimes at least partly due to sedimentation of the dyes. Regulation of solvent ratios in the ink supplied to the mist generator is accomplished as previously described by the ink density monitor.

It will be noted that saturated air flowing from the exhauster through the precipitator to the sump tank passes out again through the Condenser No. 1 before entering air pump No. 1. Condensor No. 1 Condenser a portion of the solvent vapors in the saturated air and returns the recovered solvent to the sump tank.

Saturated air leaving air pump No. 1, not utilized as either carrier air or lip air, is shown as Excess Air in FIG. 9. Excess air from air pump No. 1 is transported to Condenser No. 2 where most of the liquid solvent is condensed out and returned to the sump tank through an air lock. The resulting cleansed air may then be exhausted into the atmosphere.

It will be noted that in the diagram illustrated in FIG. 9, liquids not indicated as being transported by a pump are transported by gravity. For example, liquid ink leaving the mist generator is transported by gravity to the sump tank; and, condensed solvent leaving Condensers Nos. 1 and 2 are returned to the sump tank under gravity. By contrast, ink leaving the sump tank on its way to the mist generator is transported not by gravity but by means of an ink pump, as shown.

It will be appreciated that whereas a series of piezoelectric crystals submerged beneath a column of liquid, as illustrated in FIG. 10, and described herein, are the preferred means for generating mist in the present system, alternative mist generators can be employed. For example, the mist generator could be of the stepped horn variety which utilizes a piezoelectric crystal clamped between a horn and a resonator forming a highly tuned assembly. The crystal is electronically driven at a frequency that makes the smaller tip of the horn eject ink droplets of the desired size when liquid ink is fed to the surface of the smaller tip. Other types of atomizers such as spinning disc, pressurized nozzle or pneumatically driven atomizers can be used.

The invention has been described in considerable detail with particular reference to certain preferred embodiments thereof, but it will be understood that variations and modifications can be effected without departing from the spirit and scope of the invention.

What is claimed is:

1. Apparatus for delivering a mist of liquid ink mixture to the print region of a print head, and for recovering and recycling unused portions of the mist comprising:

a tank adapted to hold a supply of a liquid ink mixture of ink and solvent;

means for supplying carrier gas;

means for generating a mist of the liquid ink mixture, said generating means having an outlet positioned to deliver the mist to the print region, inlet means for receiving the liquid ink mixture from said tank and for receiving a carrier gas from said carrier gas supply means, means for holding a quantity of liquid ink mixture, means for agitating the liquid ink mixture in said ink holding means to produce droplets of the liquid ink mixture above the surface of liquid in said ink holding means where the droplets become entrained in the carrier gas to form the mist;

means for carrying the liquid ink mixture from said tank to said inlet means;

means for recovering unused portions of the ink mist from the print region;

means for precipitating liquid ink mixture from the recovered mist and for returning the precipitated liquid ink mixture to said tank; and means for monitoring the density of ink mixture carried to said generating means and for adding density monitor controlled quantities of ink mixture constituents to said tank to adjust the density of the mixture consistency.

2. Apparatus as recited in claim 1 wherein said means for monitoring and adding comprises:

a solvent reservoir;

a solenoid-valve-controlled conduit for carrying the solvent from said solvent reservoir to said ink mixture tank, said solenoid-controlled conduit conditioned to increase the flow of solvent therethrough in response to a first signal and to decrease the flow of solvent therethrough in response to a second signal; and means for sensing the density of the ink mixture carried to said generating means and for providing a first signal to said solenoid-controlled conduit when the ink mixture density rises above a predetermined first value, and a second signal when the ink mixture density falls below a predetermined second value, smaller than said first value.

3. Apparatus as recited in claim 2, wherein said means for monitoring and adding further comprises:

means for providing an alarm signal when the ink mixture density rises above a predetermined third value, greater than the first.

4. Apparatus as recited in claim 1 further comprising:

an ink replenishment reservoir for holding a liquid supply of ink;

a second solenoid-controlled-conduit for carrying liquid ink mixture from said ink reservoir to said ink mixture tank, said second solenoid-controlled-conduit conditioned to reduce the flow of ink mixture therethrough when the ink mixture level within said ink mixture tank rises above a predetermined first level, and to increase the flow of ink mixture therethrough when the ink mixture level within said ink mixture container falls below a predetermined second level, lower than the first.

5. Apparatus as recited in claim 4, further comprising:

an ink level alarm for signalling that said ink replenishment reservoir must be filled; and means for activating said ink level alarm when the liquid level within said ink replenishment reservoir falls below a predetermined third level lower than the second.

6. Apparatus as recited in claim 5, further comprising:

a spillage drain mounted within said ink replenishment reservoir;

means for carrying ink entering the spillage drain to said tank.

7. Apparatus as recited in claim 1, wherein said agitating means comprises ultrasonic transducer means.

8. Apparatus as recited in claim 1 wherein said agitating means comprises ultrasonic transducer means mounted beneath a predetermined liquid fill level in said liquid ink mixture holding means, said transducer means focused at the plane of said liquid fill level, and further comprising means for maintaining the volume of liquid ink mixture in said liquid ink holding means at a substantially constant level corresponding to said liquid fill level.

9. Apparatus as recited in claim 1 wherein said means for supplying carrier gas includes a source of solvent vapor saturated gas, means for condensing a portion of the solvent from said solvent vapor saturated gas to provide the carrier gas which includes remaining portions of solvent in vapor form, and means for delivering the carrier gas to said inlet means.

10. Apparatus as recited in claim 9, wherein said solvent condensing means comprises:

first means for condensing a portion of the solvent from the solvent vapor saturated gas, for transporting the condensed solvent to said tank, and for transporting a first portion of the remaining mixture of solvent vapor and carrier gas to second condensing means;

second means for condensing essentially all the solvent from the first portion of the remaining mixture of solvent vapor and carrier gas received from said first condensing means, for releasing the resulting solvent-free gas to the ambient atmosphere, and for transporting the resulting condensed solvent to said tank; and means for transporting a second portion of the mixture of solvent vapor and carrier gas from said first condensing means.

* * * * *